US006743050B1

(12) United States Patent
Wu

(10) Patent No.: US 6,743,050 B1
(45) Date of Patent: Jun. 1, 2004

(54) CABLE ASSEMBLY WITH LATCH MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/377,853

(22) Filed: Feb. 28, 2003

Related U.S. Application Data

(63) Continuation-in-part of application No. 10/316,547, filed on Dec. 10, 2002, now Pat. No. 6,699,072.

(51) Int. Cl.[7] ..... H01R 13/648
(52) U.S. Cl. ..... 439/608
(58) Field of Search ..... 439/608, 701, 439/579

(56) References Cited

U.S. PATENT DOCUMENTS

| | | | | |
|---|---|---|---|---|
| 5,924,899 A | | 7/1999 | Paagman | |
| 5,993,259 A | * | 11/1999 | Stokoe et al. | 439/608 |
| 6,083,047 A | * | 7/2000 | Paagman | 439/608 |
| 6,102,747 A | | 8/2000 | Paagman | |
| 6,139,366 A | * | 10/2000 | van Woensel | 439/609 |
| 6,146,202 A | * | 11/2000 | Ramey et al. | 439/608 |
| 6,217,364 B1 | | 4/2001 | Miskin et al. | |
| 6,238,245 B1 | * | 5/2001 | Stokoe et al. | 439/608 |
| 6,273,762 B1 | * | 8/2001 | Regnier | 439/701 |
| 6,299,483 B1 | * | 10/2001 | Cohen et al. | 439/608 |
| 6,371,788 B1 | * | 4/2002 | Bowling et al. | 439/358 |
| 6,380,485 B1 | * | 4/2002 | Beaman et al. | 174/88 R |
| 6,428,344 B1 | * | 8/2002 | Reed | 439/455 |
| 6,468,110 B2 | * | 10/2002 | Fujino et al. | 439/610 |
| 6,471,547 B1 | * | 10/2002 | Venaleck et al. | 439/608 |

* cited by examiner

*Primary Examiner*—Gary Paumen
(74) *Attorney, Agent, or Firm*—Wei Te Chung

(57) ABSTRACT

A cable assembly (1) for engaging a complementary connector includes an insulating housing (10), a number of circuit modules (20) received in the housing, a two-piece cover (30) cooperating with the housing for retaining the circuit modules, and a pair of latch members (40) attached onto opposite faces (104,106) of the housing. Each circuit module includes a circuit board (22) accommodated in the housing and a number of cables (23) mechanically and electrically connecting with the circuit board. Each latch member has a first end portion (41) disposed for detachably engaging a locking section of the complementary connector, a second opposite end portion (42) and an intermediate portion (43) between the first and second end portions and being fixed to the housing to thereby firmly secure the latch member on the housing.

2 Claims, 16 Drawing Sheets

CABLE ASSEMBLY WITH LATCH MECHANISM

CROSS-REFERENCE TO RELATED APPLICATIONS

This patent application is a continuation-in-part of a U.S. patent application Ser. No. 10/316,547, entitled "CABLE ASSEMBLY", filed on Dec. 10, 2002, now U.S. Pat. No. 6,699,072 and assigned to the same assignee with this patent application.

BACKGROUND OF THE INVENTION

1. Field of the Invention

The present invention generally relates to a cable assembly, and particularly to a cable assembly with latch mechanism for locking the cable assembly and a mating complementary connector.

2. Description of Prior Arts

With the development of communication and computer technology, high density electrical connectors are desired to construct a plurality of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al. on Apr. 17, 2001, discloses a connector assembly including a cable connector terminating a plurality of wires of a high speed electrical cable and a header connector mating with the cable connector. The cable connector has a pair of latch members on opposite sides thereof and the header connector forms two guide pins with latch portions for engaging the latch members when the connectors are mated to hold the connectors in mated condition. However, the latch portions of the guide pins are in the form of latch notches in the outside surfaces of the guide pins. Obviously, the engagement between the latch members and the guide pins is not reliable when the connectors are repeatedly mated or the mated connectors are under an incidental pull-back pressure in some circumstances. Further, each latch member is formed of spring sheet metal material and there is no particular portion for the user to effectively pull back the latch member together with the connector.

U.S. Pat. No. 5,924,899 (the '899 patent) and U.S. Pat. No. 6,102,747 (the '747 patent), both issued to Paagman, each disclose a cable assembly including a cable connector terminating a plurality of cables and a right angle header connector. In the two patents, a latch structure is employed which is secured onto a shroud of the right angle header connector for purpose of latching the cable connector onto the shroud. Particularly referring to FIGS. 3*a*–3*b* and 15 of the '899/'747 patent, the latch structure is attached to only one side of the shroud of the header connector and the locking between the two connectors is not reliable enough when the connectors are under continually plug-in operations.

Hence, it is desirable to have a cable assembly with latch mechanism by which the mateable connectors can be locked firmly and disengage from each other more easily.

BRIEF SUMMARY OF THE INVENTION

Accordingly, it is an object of the present invention to provide a cable assembly with latch mechanism by which the mateable connectors can be firmly locked.

It is another object of the present invention to provide a cable assembly with latch mechanism by which the mateable connectors can be engaged with/disengaged from each other more conveniently.

In order to achieve the above-mentioned objects, a cable assembly in accordance with the present invention for engaging a complementary connector, comprises an insulating housing, a plurality of circuit modules accommodated in the housing, a pair of latch members attached onto the housing and a two-piece cover cooperating with the housing for retaining the circuit modules. The housing defines a plurality of parallel channels along a front-to-back direction. The plurality of circuit modules each includes a circuit board received in a corresponding channel of the housing and a plurality of cables mechanically and electrically connecting with the circuit board for transmitting high speed data therethrough. Each latch member has a first end portion disposed for detachably engaging locking section of the complementary connector, a second opposite end portion and an intermediate portion interconnecting the first and second end portions. The second end portion forms a handle at a distal end thereof to be pressed and pulled to disengage the cable assembly from the complementary connector to an unmated position. The intermediate portion includes a plurality of tabs and inwardly extended pawls which are received in the housing to thereby firmly fix the latch member on the housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
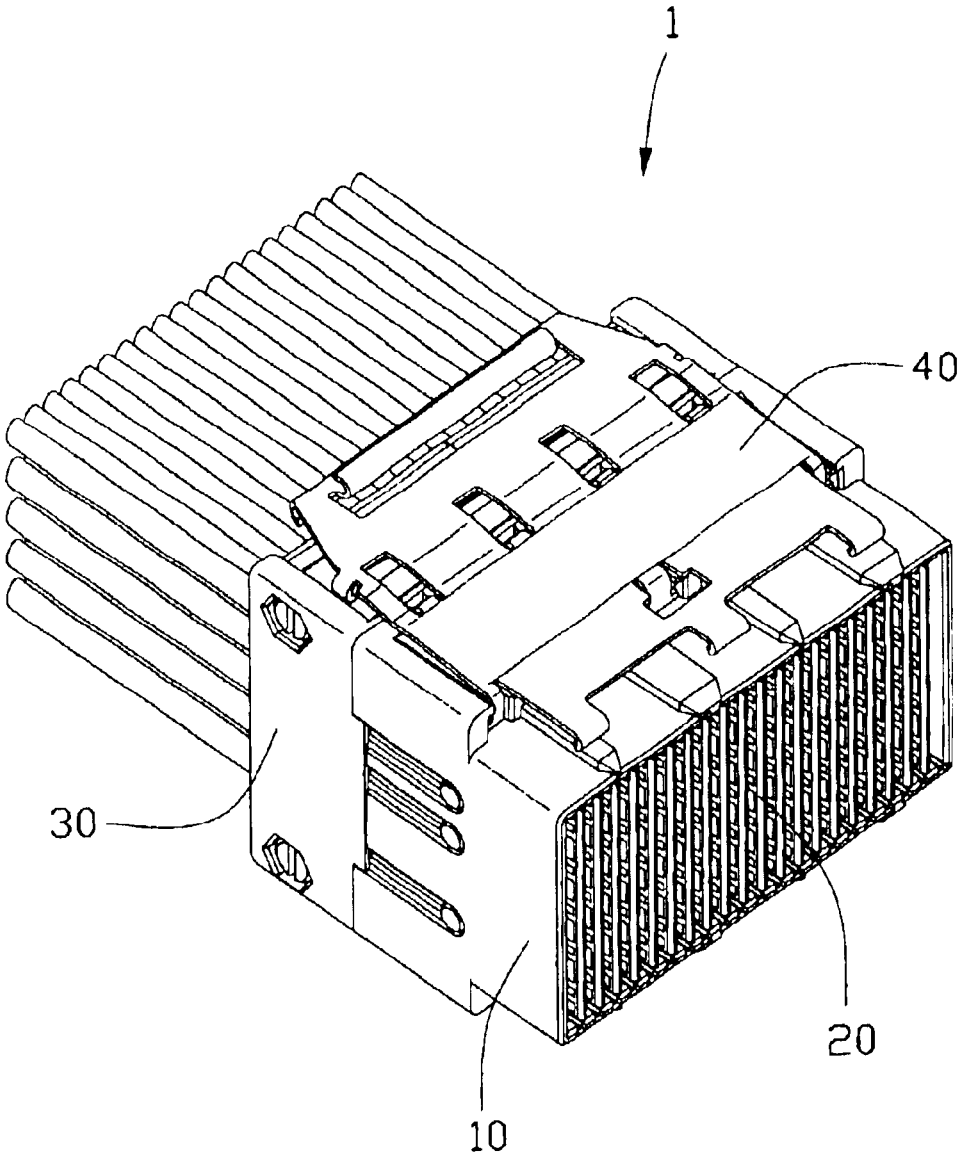
FIG. 1 is a perspective view of a cable assembly in accordance with the present invention.
Figure 2:
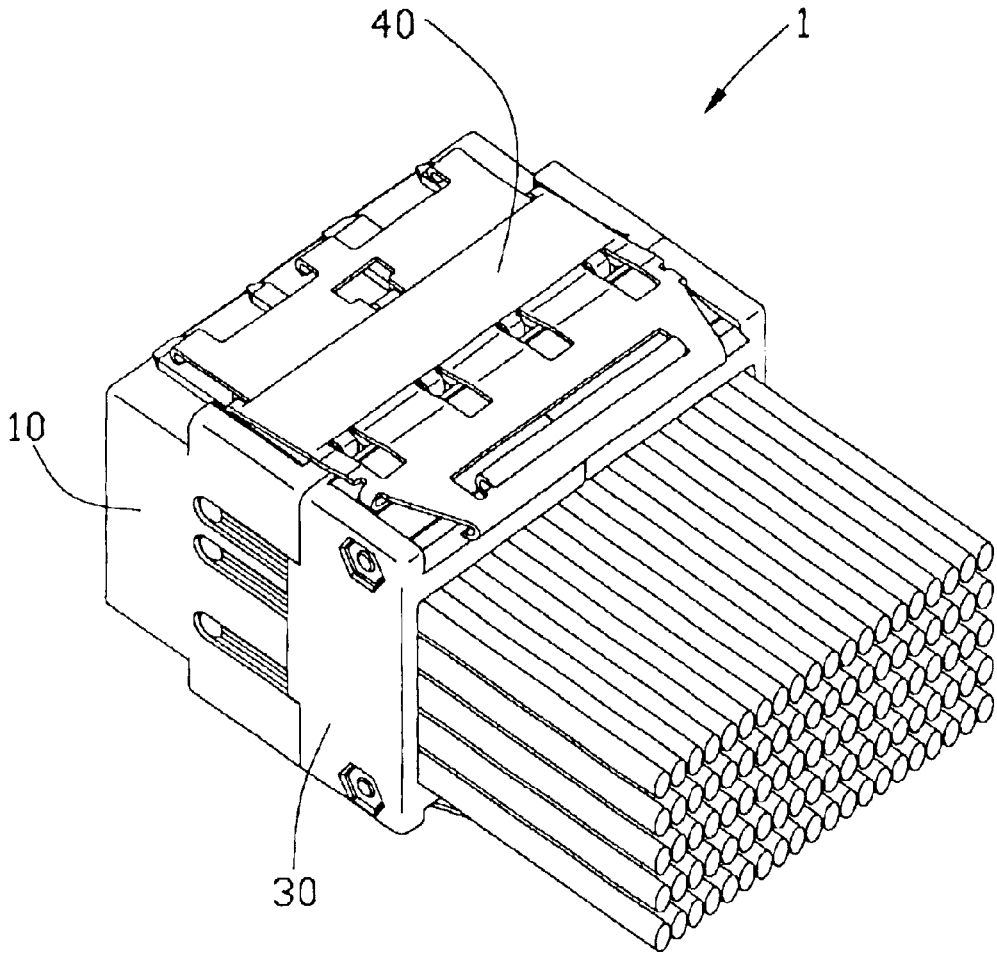
FIG. 2 is another perspective view of the cable assembly.
Figure 3:
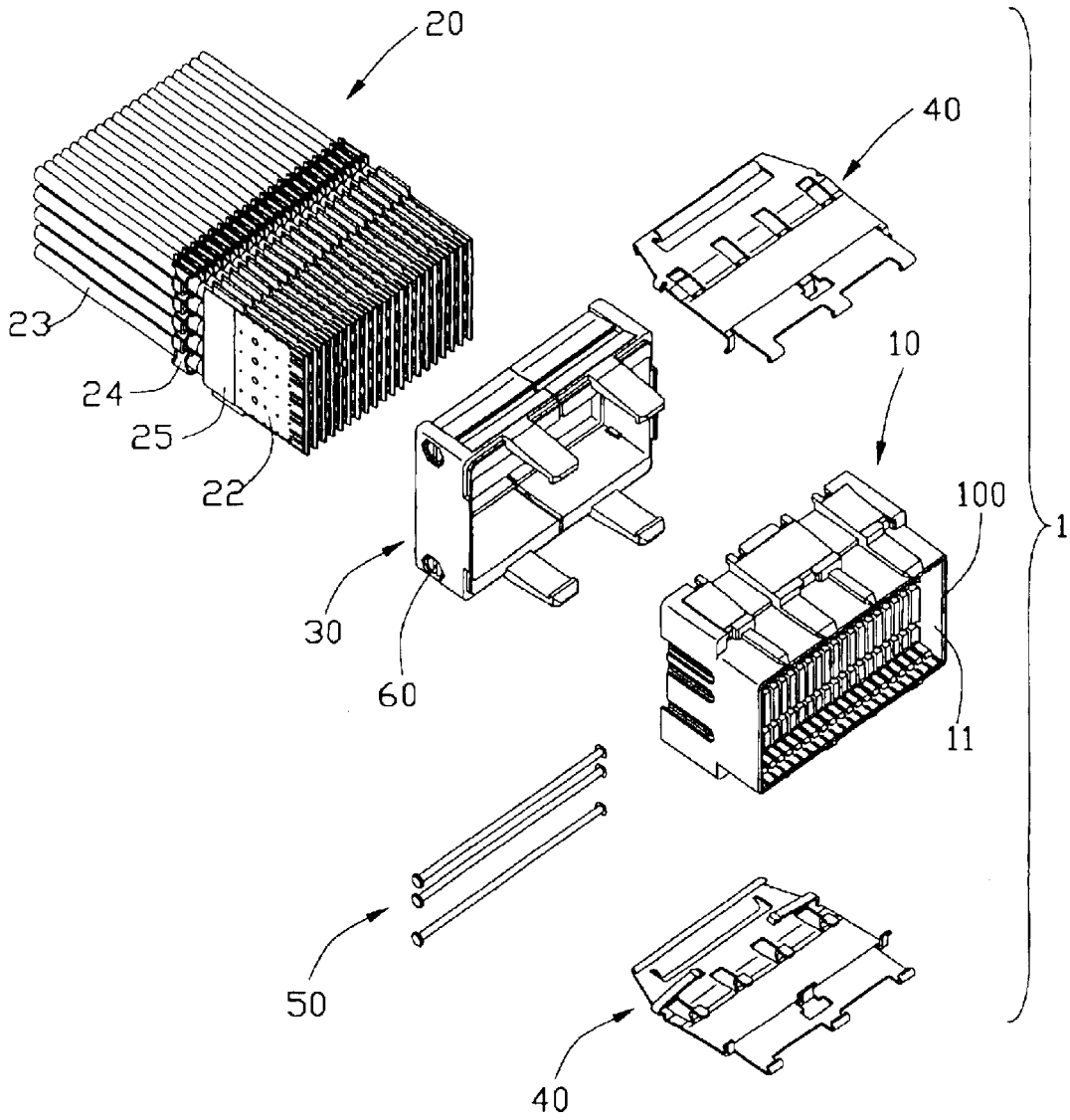
FIG. 3 is an exploded view of the cable assembly.
Figure 4:
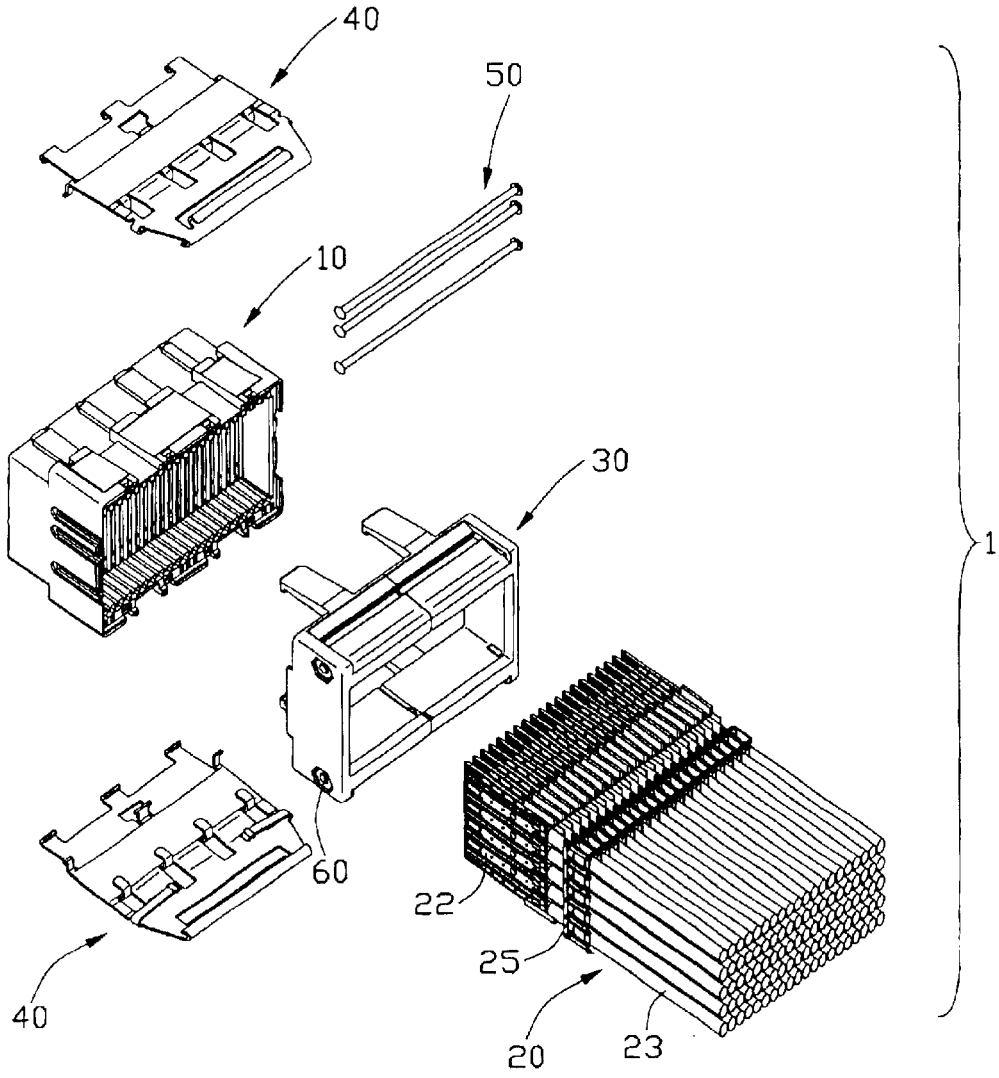
FIG. 4 is another exploded view of the cable assembly.

Reference will now be made to the drawing figures to describe the present invention in detail.

With reference to FIGS. 1–4, a cable assembly 1 in accordance with the present invention comprises a front insulating housing 10, a plurality of circuit modules 20 received in the front insulating housing 10, a two-piece rear cover 30 together with the front insulating housing 10 for retaining the circuit modules 20, and a pair of latch members 40 secured to the front housing 10.

Figure 5:
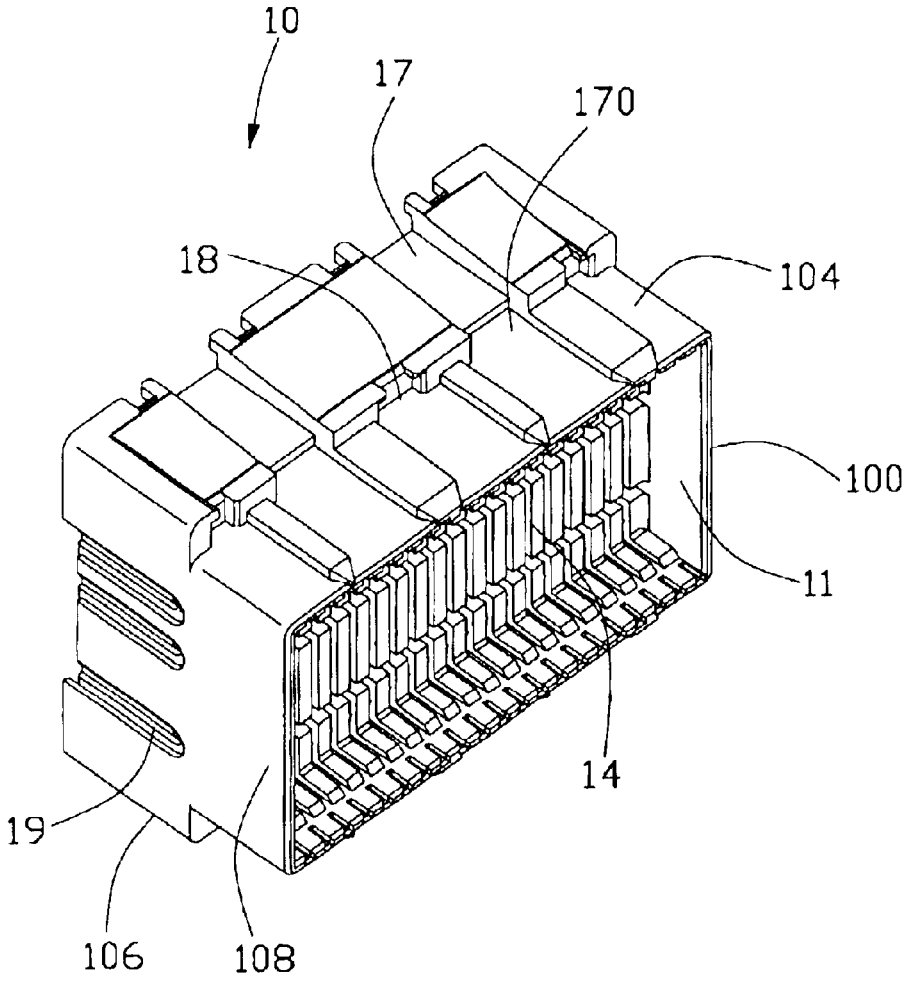
FIG. 5 is a perspective view of a housing of the cable assembly.
Figure 6:
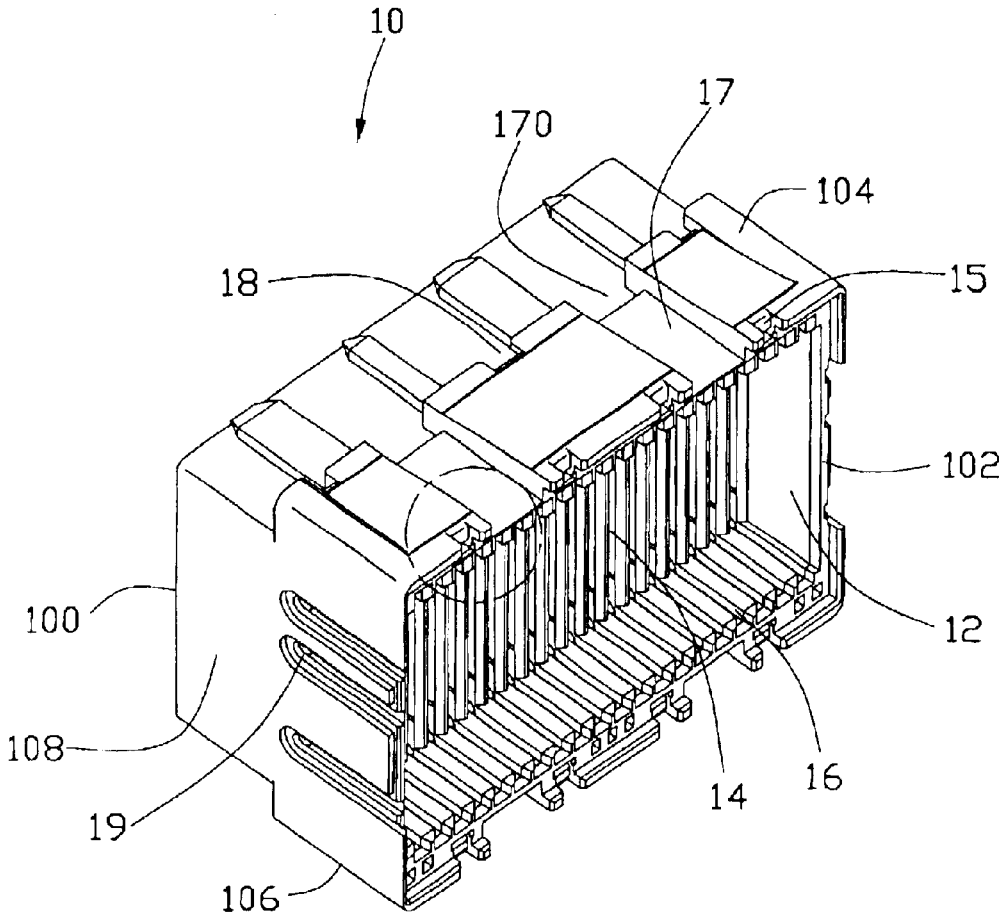
FIG. 6 is another perspective view of the housing.
Figure 7:
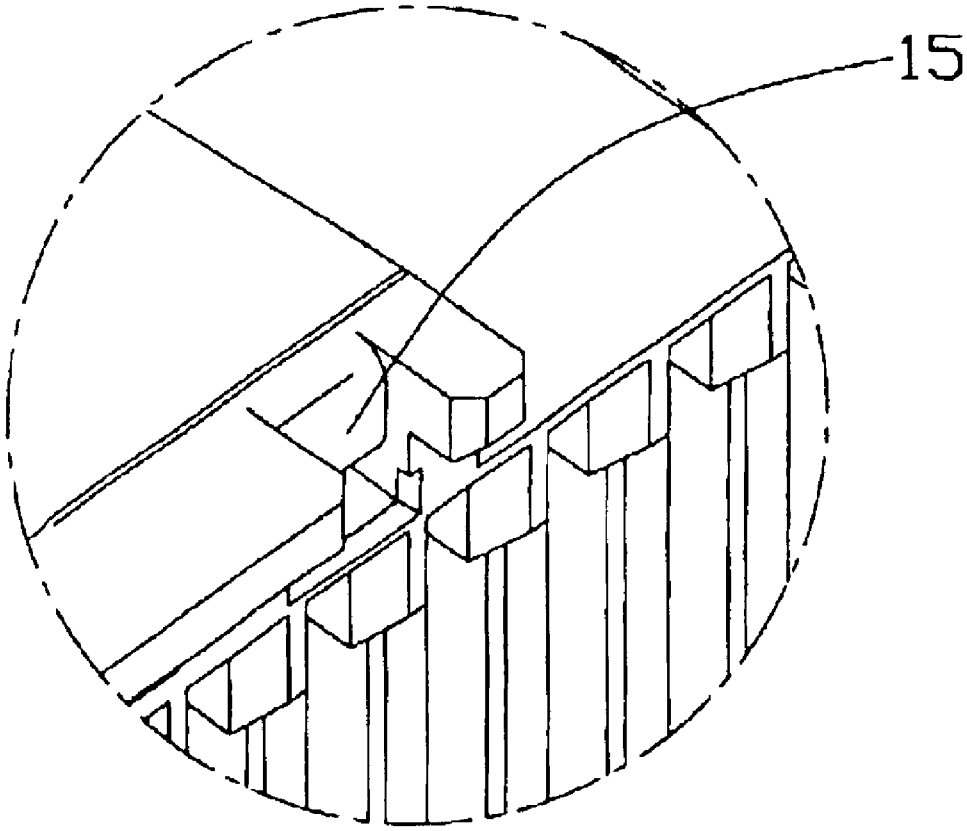
FIG. 7 is a partially enlarged view of the housing.

Referring to FIGS. 5 and 6, the front insulating housing 10 is generally in a rectangular shape. The housing 10 has a front mating port 11 in a front mating face 100 facing a complementary connector (not shown) and a rear chamber 12 in a rear face 102. The housing 10 defines a plurality of parallel channels 14 extending in a front-to-back direction communicating with the front port 11 and the rear chamber 12 and a plurality of grooves 16 which are aligned with the channels 14. The housing 10 further defines a plurality of recesses 17 respectively in a top face 104 and a bottom face 106 and a plurality of depressions 170 depressed downwardly from the corresponding recesses 17. A plurality of indents 18 are defined in top and bottom faces 104, 106 of the housing 10 and are staggered with the depressions 170. The housing 10 also defines a plurality of apertures 19 through opposite side faces 108 in a direction substantially perpendicular to the extending direction of the channels 14. Particularly referring to FIG. 7, a plurality of cavities 15 are defined in a rear side of both the top and bottom faces 104, 106 of the housing 10.

Referring back to FIGS. 3–4, each one of the circuit modules 20 is identical in structure and each circuit module 20 comprises a circuit board 22 and a plurality of cables 23 electrically and mechanically connecting with the circuit board 22. The circuit board 22 includes a dielectric substrate made of conventional circuit board substrate material, a plurality of conductive signal traces (not labeled) on one side of the substrate for providing electrical paths through the cable assembly 1 and a plurality of grounding traces (not labeled) on both sides of the substrate for grounding purpose. The cables 23 of each circuit module 20 are arranged in a common plane and have conductive cores (not labeled) soldered to the signal traces on the circuit board 22. The circuit module 20 further comprises a grounding plate 24 and a cable clamp 25 adapted for being applied to the cables 23. The detailed description about the grounding plate 24 and the cable clamp 25 can be found in the parent U.S. patent application Ser. No. 10/316,547.

Figure 8:
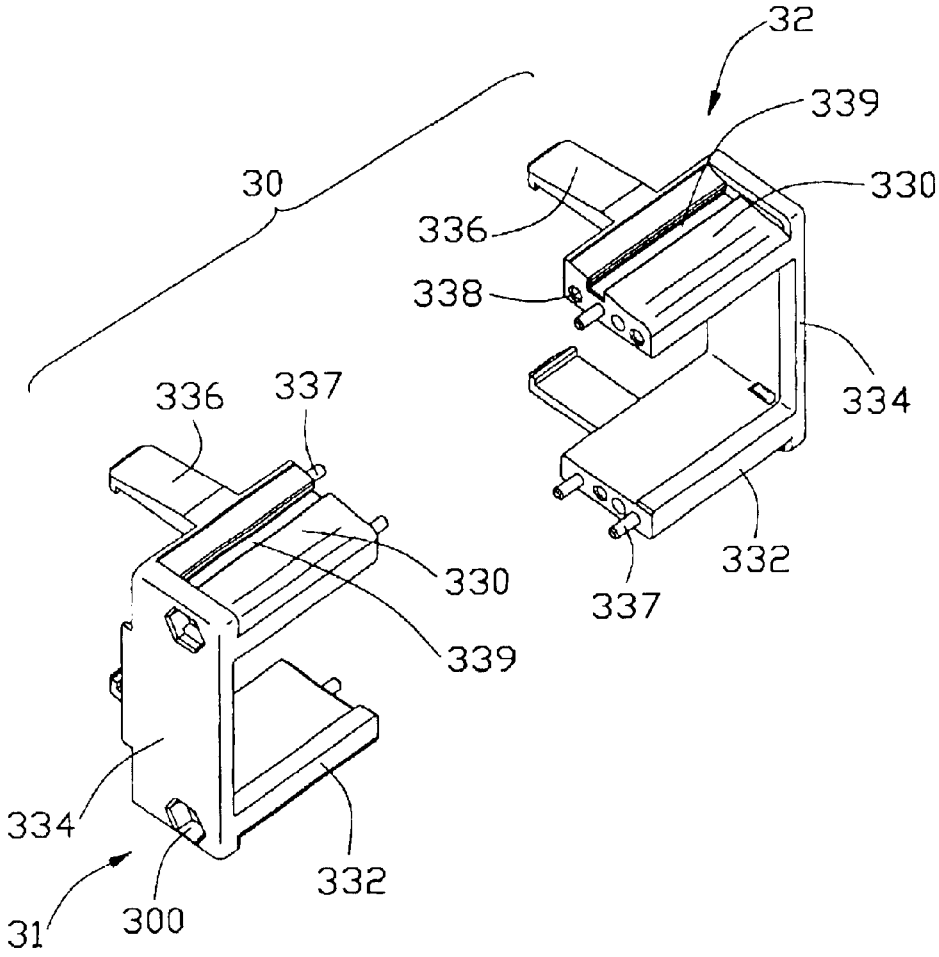
FIG. 8 is an exploded, perspective view of a cover of the cable assembly.

Referring to FIG. 8, the rear cover 30 comprises a split body having a first half 31 and a second half 32. Each half 31, 32 has a top panel 330, a bottom panel 332 and a side panel 334 formed between the top and bottom panels 330, 332. Each half 31, 32 forms a pair of latches 336 extending forwardly from front edges of the top and bottom panels 330, 332, a plurality of dowel pins 337 and corresponding holes 338 for joining the first half 31 and the second half 32 together. The rear cover 30 defines a plurality of bores 300 extending through the side panels 334 thereof. It should be noted that any other suitable connecting means might be employed to connect the first and second halves 31, 32. This split design helps to facilitate the assembly and installation of the cover 30 onto the housing 10 over the circuit modules 20. Further, each half 31, 32 defines a slot 339 traversing the top and bottom panels 330, 332, correspondingly.

Figure 9:
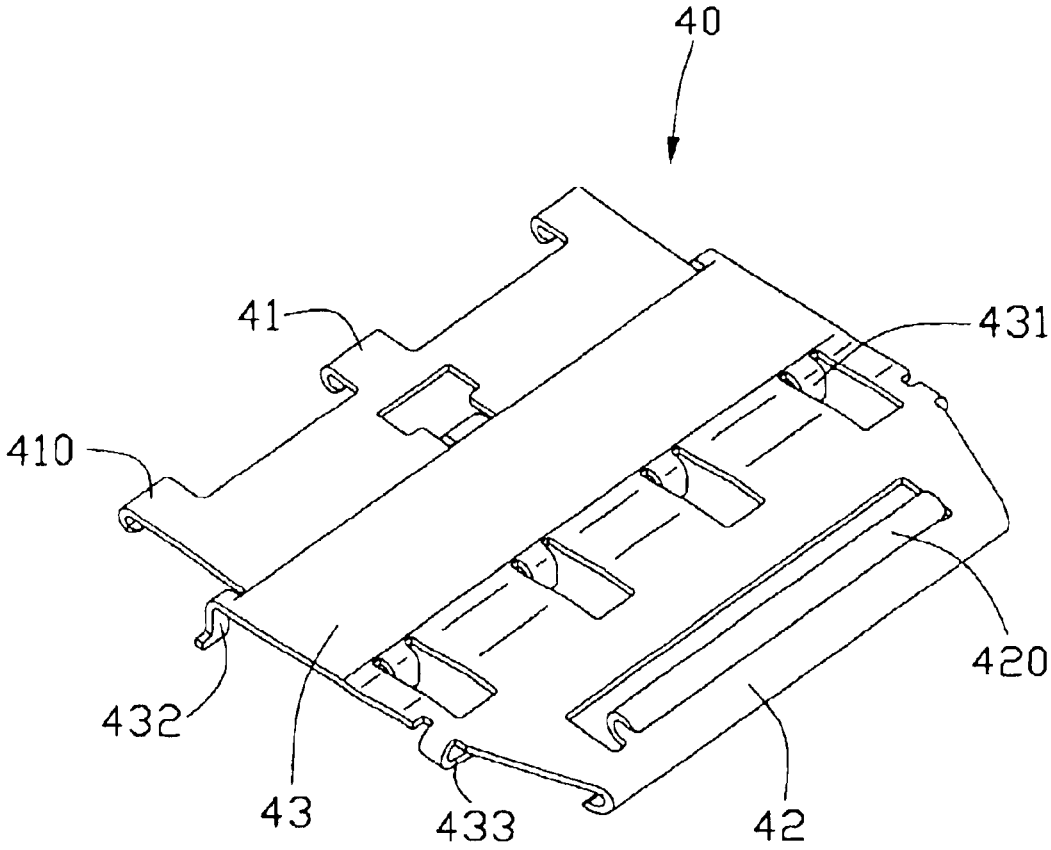
FIG. 9 is a perspective view of a latch member of the cable assembly.
Figure 10:
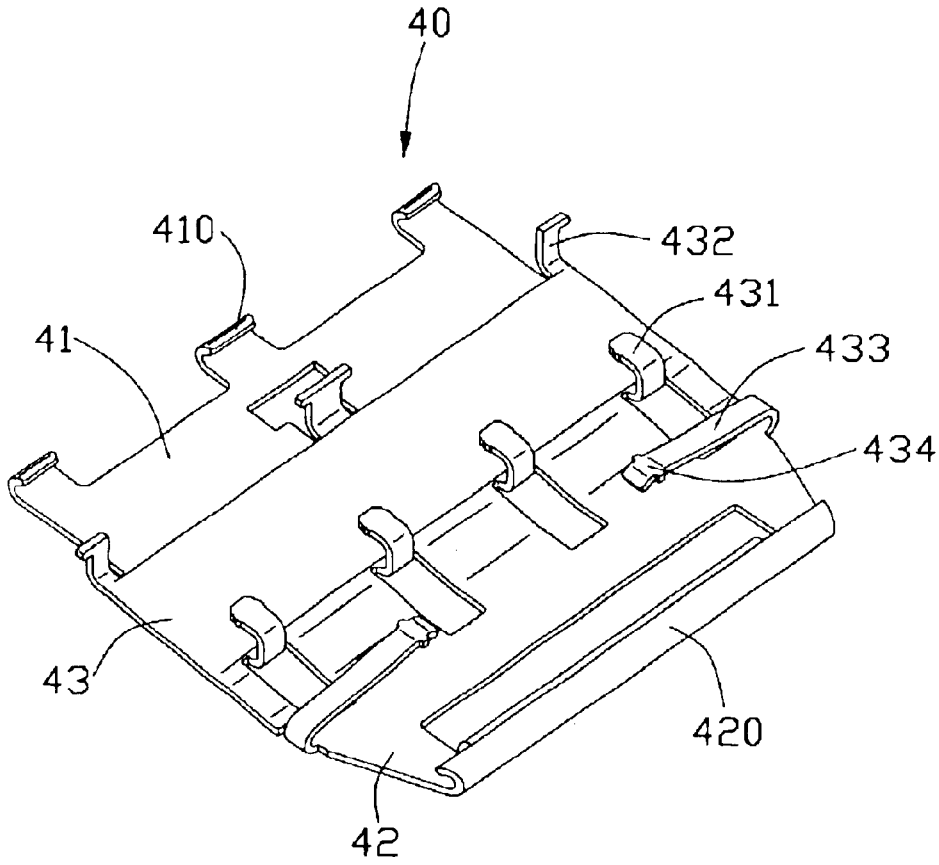
FIG. 10 is another perspective view of the latch member.
Figure 11:
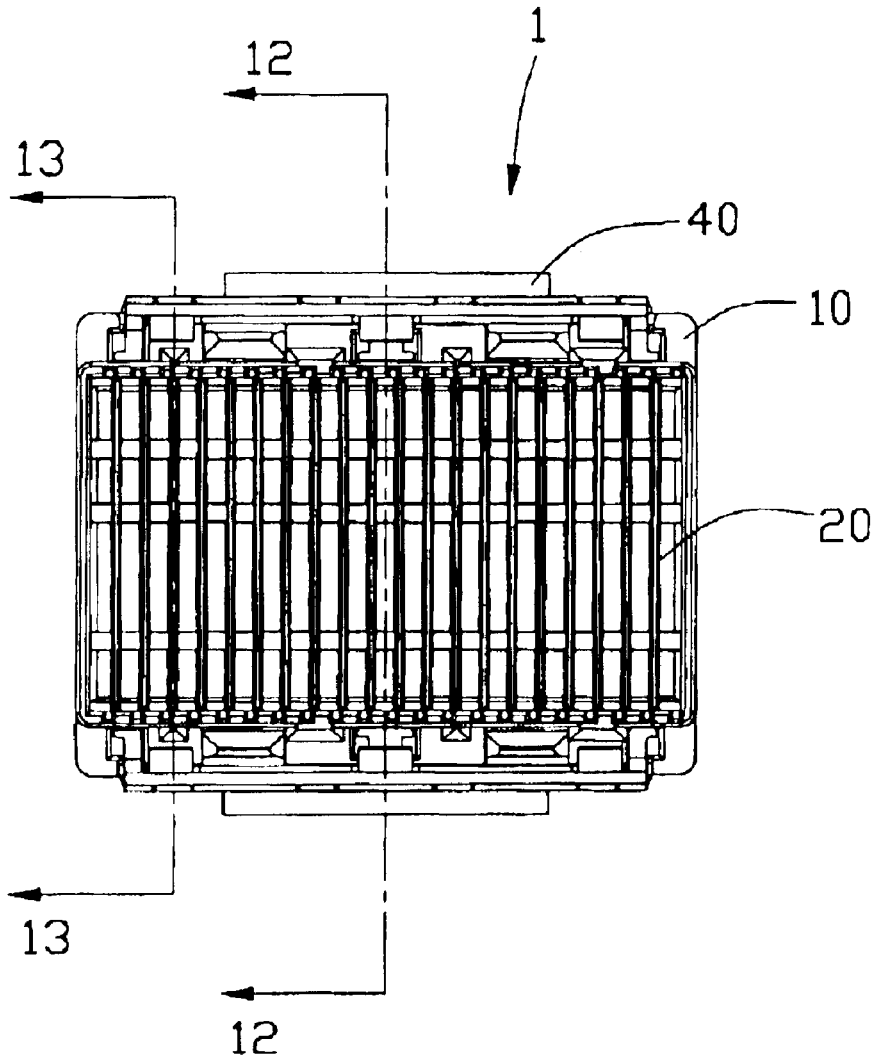
FIG. 11 is a front plan view of the cable assembly.
Figure 12:
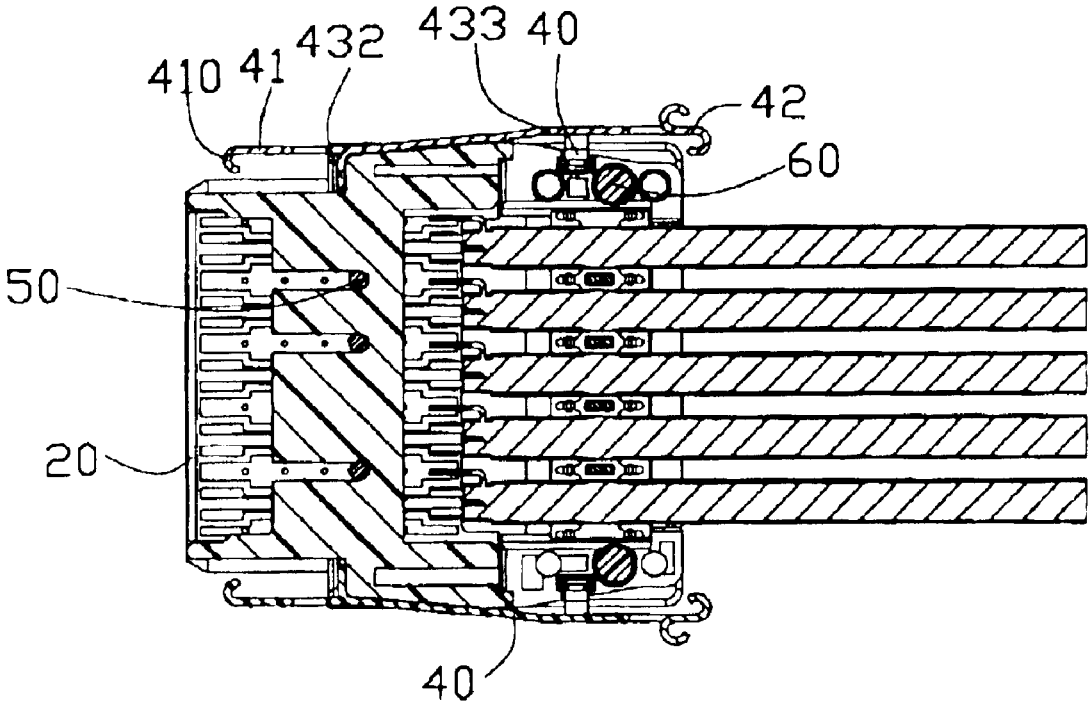
FIG. 12 is a cross-sectional view of the cable assembly taken along section line 12—12 in FIG. 11.
Figure 13:
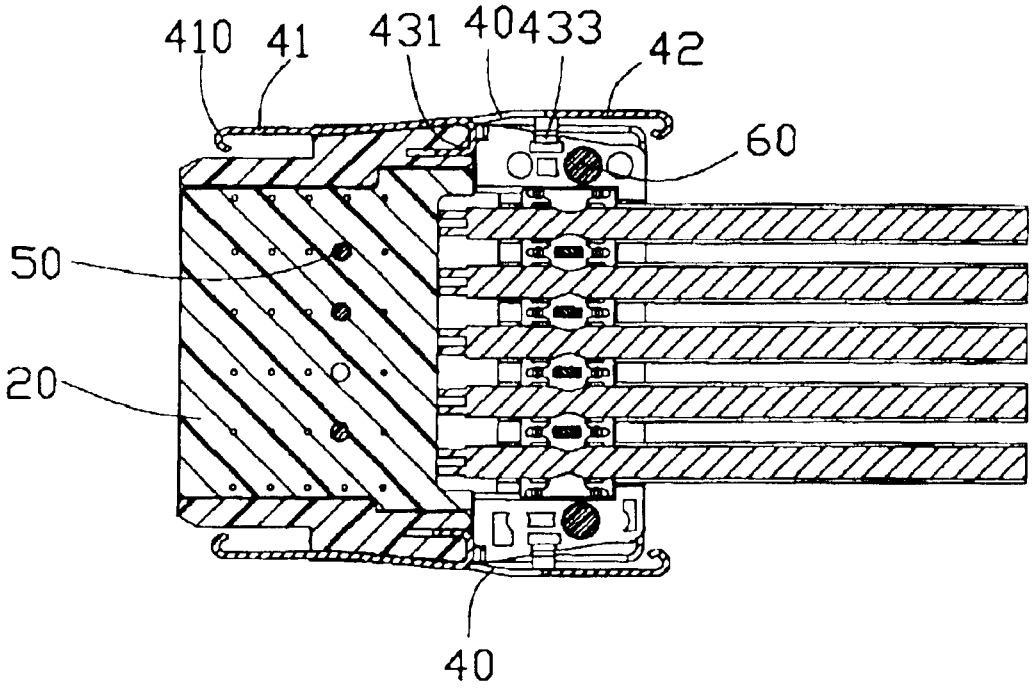
FIG. 13 is a cross-sectional view of the cable assembly taken along section line 13—13 in FIG. 11.
Figure 14:
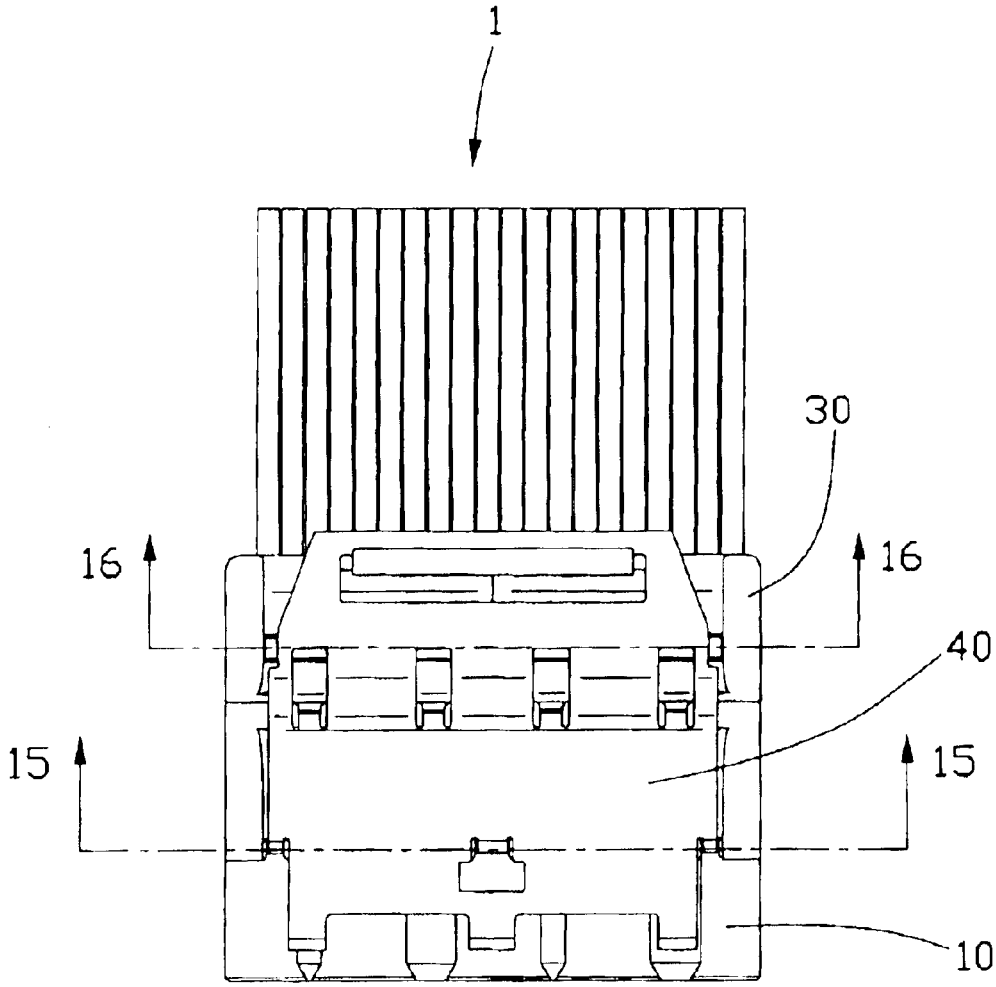
FIG. 14 is a top plan view of the cable assembly.
Figure 15:
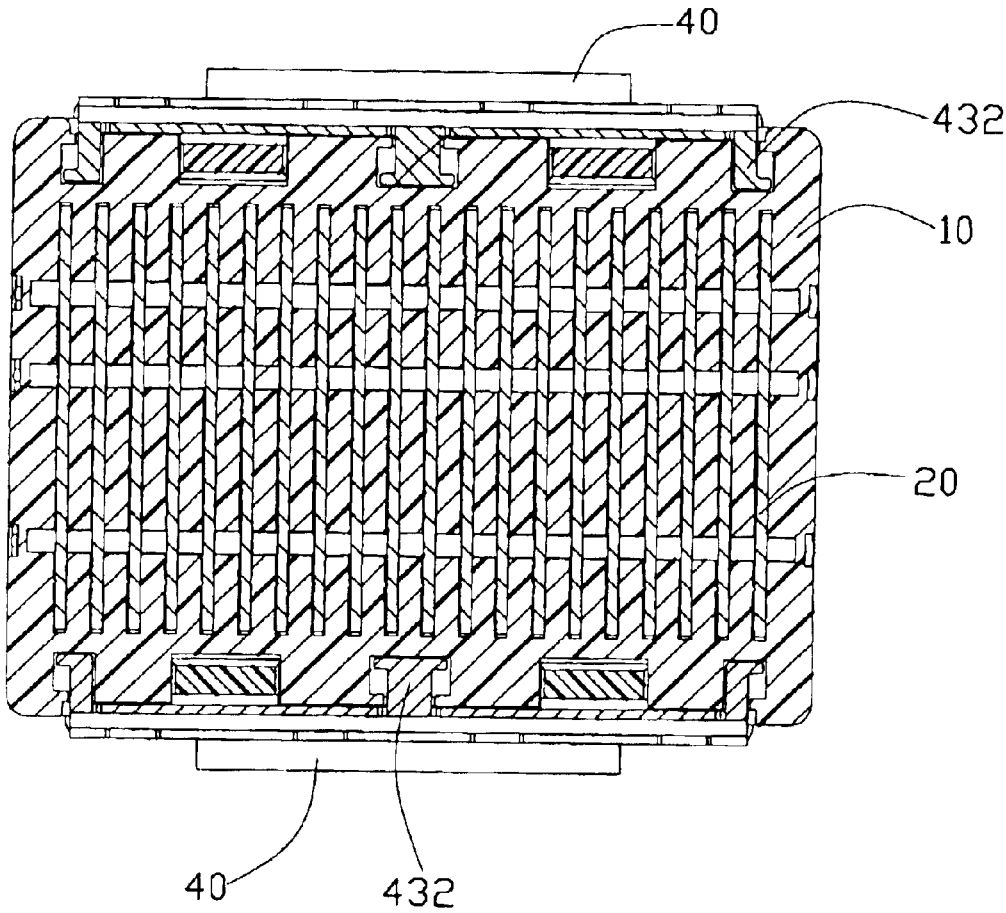
FIG. 15 is an enlarged, cross-sectional view of the cable assembly taken along section line 15—15 in FIG. 14.
Figure 16:
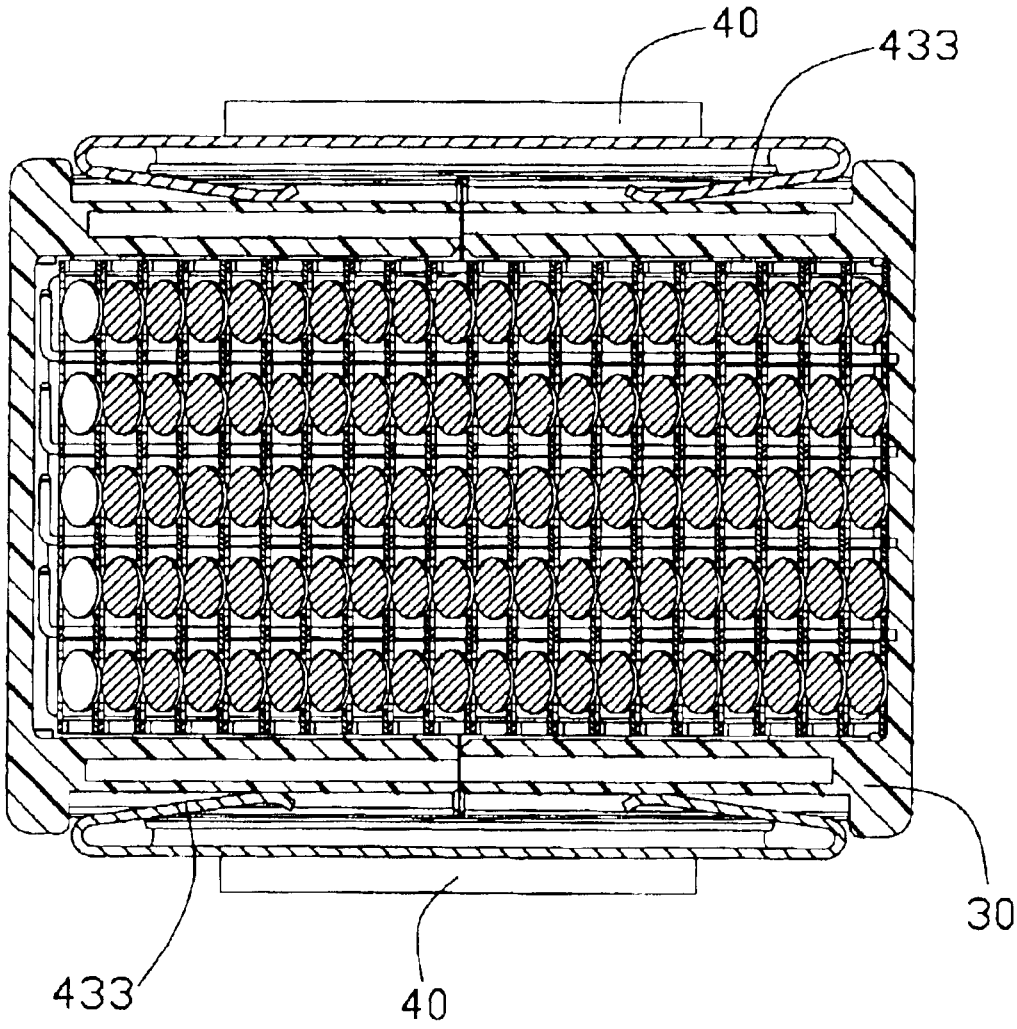
FIG. 16 is an enlarged, cross-sectional view of the cable assembly taken along section line 16—16 in FIG. 14.

Turn to FIGS. 9 and 10, the pair of latch members 40 are attached respectively on the top and bottom faces 104, 106 of the front housing 10. The latch members 40 are stamped from a piece of metal material and each include a first free end 41, a second free end 42, and an intermediate portion 43 connecting the first free end 41 and the second free end 42. The first free end 41 forms a plurality of detents 410 for engaging corresponding engaging section of the complementary connector to thereby firmly fasten the cable assembly 1 and the complementary connector when the connectors are in mated position. The second free end 42 forms a handle 420 at a distal end thereof, by which the cable assembly 1 can be pulled back and disengage from the complementary connector. The intermediate portion 43 comprises a plurality of inwards extended pawls 431 formed in a middle section, a plurality of tabs 432 stamped adjacent to the first free end 41, and a pair of resilient arms 433 extending towards each other in the proximity of the second free end 42. Each resilient arm 433 has an enlarged portion 434 formed at a distal end thereof, the function of which will be described in great detail hereinafter.

Referring back to FIGS. 3–4 in conjunction with FIGS. 5–10, in assembly, the circuit modules 20 are inserted into the channels 14 of the housing 10 from the rear face 102 until the circuit boards 22 arrive at a position where front ends of the circuit boards 22 are substantially adjacent to the front mating face 100 of the housing 10 and top and bottom ends of the circuit boards 22 are substantially retained in the grooves 16. First fastening elements 50 are inserted into through-holes (not labeled) of the circuit boards 22 through corresponding apertures 19 of the housing 10. The first fastening elements 50 are further fastened to the housing 10 for keeping the circuit modules 20 in their original position rather than be pushed back when the cable assembly 1 mates with the complementary connector, thereby stably retaining the circuit modules 20 in the housing 10.

Then, the latch members 40 are assembled on the first and second halves 31, 32 of the cover 30 with corresponding resilient arms 433 being respectively received in the slots 339 of the cover 30. Simultaneously, the first and second halves 31, 32 are connected by an interference engagement between the dowel pins 337 and the corresponding holes 338. The cover 30 and the latch members 40 are consequently assembled to the housing 10. The latches 336 of the cover 30 mechanically engage the depressions 170 of the recesses 17 of the housing 10. The cover 30 is disposed around the cable clamps 25 of the circuit modules 20. Second fastening elements 60 are inserted into corresponding bores 300 of the cover 30 for retaining the cable clamps 25 in the cover 30.

Referring to FIGS. 11–16 in conjunction with FIGS. 1–4, the engagement between the latch members 40 and the housing 10 is shown in great detail herein. The inwards extended pawls 431 of the intermediate portion 43 of the latch member 40 are projecting into the cavities 15 of the housing 10 which prevent the latch member 40 from moving away from the housing 10. Similarly, the tabs 432 of the latch member 40 are respectively accommodated in the indents 18 of the housing 10 which prevent the first free end 41 of the latch member 40 from upwards or backwards moving from the housing 10, thereby firmly fixing the latch member 40 on the housing 10. Further, the pair of resilient arms 433 of each latch member 40 are partially received in the slots 339 of the two halves 31, 32 of the cover 30 under spring tension during the cable assembly 1 and the complementary connector in a mated condition, while, the resilient arms 433 are entirely received in the slots 339 when the cable assembly 1 is required to disengage from the complementary connector by squeezing the second free end 42 towards the housing 10. It should be noted here that the enlarged portion 434 of each resilient arm 433 is received and limited in the corresponding slot 339 so that the resilient arm 433 can move only along an up-to-down direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

I claim:

1. A cable assembly for engaging a complementary connector that has at least one locking section, comprising:

an insulating housing defining a plurality of channels;

a plurality of circuit modules each comprising a circuit board received in a corresponding channel of the housing and a plurality of cables mechanically and electrically connecting with the circuit board; and at least one latch member being fixed to the housing and comprising a first end portion adapted for detachably engaging the locking section of the complementary connector and a second opposite end portion operable to disengage the first end portion from the complementary connector;

wherein the second end portion comprises a handle formed at a distal end thereof, by which the cable assembly is pulled back and moves away from the complementary connector;

wherein the first end portion comprises at least one detent for engaging the locking section of the complementary connector and holding the cable assembly and the complementary connector in mated condition;

wherein the latch member has a plurality of inwardly projected pawls and the housing comprises a top face defining a plurality of cavities for retaining the corresponding pawls;

wherein the latch member has a plurality of tabs stamped therefrom in the proximity of the first end portion, and the top face of the housing defines a plurality of indents for receiving the corresponding tabs;

further comprising a cover defining a pair of slots, and wherein the latch member comprises a pair of resilient arms extending in the corresponding slots;

wherein each circuit module further comprises a cable clamp bonding the cables together;

further comprising a fastening element and wherein each circuit board defines a through-hole for extension of the fastening element.

2. A cable assembly for engaging a complementary connector, comprising:

an insulating housing defining a plurality of parallel channels;

a plurality of circuit modules each comprising a circuit board received in a corresponding channel of the housing and a plurality of cables electrically connecting with the circuit board;

a cover; and a latch member assembled on the housing and adapted for interlocking the cable assembly with the complementary connector in a mated position;

wherein the latch member comprises a first free end for cooperating with the complementary connector, a second free end for disengaging the cable assembly from the complementary connector, and an intermediate portion connecting the first and second free ends and being fixed to the housing;

wherein the intermediate portion of the latch member comprises a plurality of inwardly extending pawls and the housing comprises a toop face defining a plurality of cavities for retaining the corresponding pawls;

wherein the first free end comprises a plurality of detents for locking with the complementary connector;

wherein the latch member comprises a pair of resilient arms extending between the latch member and the cover, and the cover defines a pair of slots for correspondingly receiving the resilient arms, the resilient arms being formed adjacent to the second free end;

wherein the latch member comprises a plurality of tabs stamped therefrom in the proximity of the first free end, and the top face of the housing devines a plurality of indents for receiving the corresponding tabs;

wherein the cover comprises two havles jointed with each other and a fastening means fastening the two halves together.

* * * * *